US005445119A

United States Patent [19]

Regueiro

[11] Patent Number: 5,445,119

[45] Date of Patent: Aug. 29, 1995

[54] TAPPET AND SHIM ASSEMBLY FOR INTERNAL COMBUSTION ENGINE

[75] Inventor: José F. Regueiro, Rochester Hills, Mich.

[73] Assignee: Chrysler Corporation, Highland Park, Mich.

[21] Appl. No.: 352,943

[22] Filed: Dec. 9, 1994

[51] Int. Cl.[6] ..... F01L 1/16

[52] U.S. Cl. ..... 123/90.48; 123/90.51; 74/569

[58] Field of Search ..... 123/90.48, 90.49, 90.5, 123/90.51, 90.52, 90.55; 74/569

[56] References Cited

U.S. PATENT DOCUMENTS

| | | | |
|---|---|---|---|
| 2,891,525 | 6/1959 | Moore | 123/90.51 |
| 3,025,842 | 3/1962 | Slooten | 123/90.51 |
| 3,073,292 | 1/1963 | Behnke et al. | 123/90.51 |
| 4,638,772 | 1/1987 | Burandt | 123/90.6 |
| 4,745,888 | 5/1988 | Kapp | 123/90.51 |
| 4,909,198 | 3/1990 | Shiraya et al. | 123/90.51 |
| 5,213,072 | 5/1993 | Dohring | 123/90.48 |
| 5,237,967 | 8/1993 | Willermet et al. | 123/90.51 |
| 5,251,587 | 10/1993 | Mori | 123/90.48 |
| 5,269,268 | 12/1993 | Hara | 123/90.48 |
| 5,284,112 | 2/1994 | Takehara et al. | 123/90.48 |
| 5,320,074 | 6/1994 | Schultz et al. | 123/90.51 |

FOREIGN PATENT DOCUMENTS

| | | | |
|---|---|---|---|
| 4031834 | 4/1992 | Germany | 123/90.48 |

*Primary Examiner*—Henry C. Yuen
*Assistant Examiner*—Weilun Lo
*Attorney, Agent, or Firm*—Kenneth H. MacLean

[57] ABSTRACT

A tappet and shim assembly is disclosed for operating directly between a valve and a camshaft lobe in an internal combustion engine. The assembly comprises a tappet having a shallow cylindrical recess in one end that is concentric with an outer cylindrical surface of the tappet. A dual-diameter cylindrical shim is provided with concentric small and large diameter cylindrical portions wherein the large cylindrical portion has a diameter that is sufficiently large so that a flat end surface thereof contacts with a lobe of a camshaft without the lobe contacting the edge of this surface. The small diameter portion of the shim is received in the recess of the tappet and the diameter of the outer cylindrical surface of the latter is made just slightly larger than that of the large diameter portion of the shim so that the latter is received with clearance in the bore in which the tappet is received. The small diameter portion of the shim is provided with an axial dimension such that when it is bottomed out in the recess in the tappet, the large diameter portion of the shim is located at a distance from the tappet to form an annular space therebetween for insertion of a sharp tipped tool to remove the shim from the tappet.

8 Claims, 2 Drawing Sheets

TAPPET AND SHIM ASSEMBLY FOR INTERNAL COMBUSTION ENGINE

TECHNICAL FIELD

This invention relates to tappet and shim assemblies for internal combustion engines with a direct acting camshaft and more particularly to those wherein the shim is received in a recess in one end of the tappet and is adapted to be contacted by a lobe of the camshaft.

BACKGROUND OF THE INVENTION

In internal combustion engines that employ a direct acting camshaft, it is common practice to have the cam lobes act directly on the valves through bucket type tappets (also commonly called cam followers) that are mounted in bores in the cylinder head or in a cam supporting structure attached to the cylinder head. In such a valve train, the valve clearance may be set at the tappet in various ways to adjust for manufacturing tolerance stack-ups at assembly and later compensate for wear and for valve and valve seat regrinds in an engine overhaul. One way to set the valve clearance is to position a small shim of the proper thickness between the valve stem and the tappet. Another way is to position a thin cylindrical shim between the tappet and the camshaft lobe in which case the shim is normally received in a shallow cylindrical recess in the top of the tappet. In the former case, one end of the tappet is contacted directly by a lobe of the camshaft and the tappet is provided with a large enough diameter so that the cam lobe does not contact with the edge of the tappet at this end and cause excessive wear of the tappet and/or the cam lobe. In the latter case and for the same valve and camshaft application, the diameter of the tappet must be increased to accommodate a shim having the diameter of the tappet in the former case so as to avoid edge contact of the shim with the cam lobe. The latter case thus requires a larger tappet diameter but has the advantage of allowing installation of the shims on the tops of the tappets with the camshaft in place whereas the camshaft and the tappets in the former case must be removed to allow the installation of shims of the proper thickness between the tappets and their associated valve stem. Examples of tappets with a cylindrical shim mounted in a recess in their top can be seen in U.S. Pat. Nos. 4,638,772; 4,909,198; 5,213,072; 5,269,268 and 5,237,967.

The use of a shim in the top of the tappet is thus preferred for installation purposes but has the disadvantage of requiring a larger tappet with a corresponding increase in weight of both the shim and the tappet which adds to the inertia of the valve train. Moreover, the relatively large tappet diameter that is required can present space problems in certain engine designs that are difficult to overcome. For example, there is typically very little space to locate conventional size tappets without interference in a dual overhead camshaft, 4-valve engine with a small bore/stroke ratio. For example, where it is discovered in the engine design stage that there is interference between a well designed tappet and camshaft bearing saddle, the size of either the bearing saddle and/or the diameter of the shim and tappet could possibly be reduced. But these changes could compromises their design. For example, a reduction in the cam bearing surface could significantly reduce the load carrying ability and force a compromise in the bearing lubrication. On the other hand, there is designed into the camshaft a desired valve lift and such a reduction in shim and tappet diameter would require a reduction in the desired valve lift limiting its effectiveness thermodynamically or require a reduction in the base circle of the cam lobes and correspondingly the shank diameter between the cam lobes thereby weakening the camshaft.

Another important consideration is the material of which both the camshaft and shims are made. Where the camshaft is made of cast iron, it is common practice to employ shims that are made of hardened steel for good wear compatibility and strength. On the other hand, where the camshaft is made of steel, it is desirable to employ shims that are made of cast iron but they must normally be made thicker than a corresponding steel shim so that they can be hardened at their contact surface such as in a chilled casting process while leaving a relatively large remaining thickness soft for strength purposes. As a result, a properly designed cast iron shim can add to both the size and weight of the tappet and shim assembly. For example, a typical hardened steel shim may have a thickness of about 2.0 mm but a cast iron shim of this thickness will become brittle if chilled-cast and is prone to cracking and breaking. As a result, cast iron shims are made with about twice the thickness of a steel shim or about 4.0 mm so that their cam contacting surface can be properly hardened while a soft core is left for strength.

Another important consideration is with respect to the ability to easily replace the shims during service or in an engine overhaul. From an optimum load design standpoint, the shims require a minimum thickness for strength and they need project only slightly above the top of the tappet where there are mounted in the recess. Moreover, they require a minimum containment depth, i.e. that of their accommodating recess in the top of the tappet. However, the shims are normally made substantially thicker than required for strength and containment purposes so as to be available in a range of thicknesses to compensate for manufacturing tolerance stack-ups, wear in service, and valve and valve seat regrinds during overhaul. In addition, they are provided with a large enough thickness such that they project a substantial distance above the top of the tappet so as to present an area that can be grasped or engaged by a tool for their removal. The shims tend to be retained in their recess by the surface tension of oil between the flat bottom of the recess and the flat bottom side of the shim and it can be very difficult with just their projecting cylindrical surface to effect their removal. And even without surface tension tending to retain the shims, the shims can be difficult to remove because even slight tilting thereof in their recess during an attempted removal can cause them to become stuck.

SUMMARY OF THE INVENTION

The present invention is directed to minimizing the diameter of the tappet where the shim is received in a recess in the top thereof. Moreover, the present invention provides for easy removal of the shim with a simple common tool such as a screw driver while also providing for optimum use of a shim made of cast or powdered iron. This is accomplished with a tappet and shim assembly comprising a bucket type tappet and a dual-diameter shim. The shim is provided with concentric small and large diameter portions wherein the large diameter portion is adapted to contact at its end with a cam lobe and is provided with the minimum diameter necessary to avoid edge contact therewith. The tappet is formed with a cylindrical recess in one end that receives the small diameter portion of the shim and is concentric with the outer cylindrical surface of the tappet as in the usual manner. However, the diameter of the tappet can now be made smaller than normal as the recess is only required to receive the small diameter portion of the shim while the tappet diameter is made only slightly larger than that of the large diameter shim portion so as to permit same to enter the tappet bore with clearance. In addition, the small diameter shim portion is provided with an axial length or thickness such that when it bottoms out in the recess in the tappet, the large diameter shim portion is positioned at a distance from this one end of the tappet to form an annular space therebetween for insertion of a sharp edge tool such the tip of a screw driver to remove the shim from the tappet.

Servicing of the tappets with new shims while the camshaft remains in place is facilitated by the formation of a pair of notches in the back edge of the large diameter shim portion. The notches allow the insertion of a tool between an existing shim and the tappet to depress the latter and allow the insertion of another dual-diameter shim of desired thickness.

It is therefore an object of the present invention to provide a new and improved tappet and cam contacting shim assembly for operating between a camshaft and a valve in an internal combustion engine.

Another object is to provide a tappet and shim assembly for operating between a camshaft and a valve in an internal combustion engine wherein the shim contacts with a cam lobe, is received in a recess in the face of the tappet and has a stepped diameter allowing the use of a tappet having a smaller than normal diameter.

Another object is to provide a tappet and shim assembly for operating between a camshaft and a valve in an internal combustion engine wherein the shim has a cam contact surface of suitable minimum diameter and the tappet has a diameter that is only slightly larger.

Another object is to provide a tappet and shim assembly for operating between a camshaft and a valve in an internal combustion engine wherein the shim is received in the top of the tappet and has a cam contact surface of suitable minimum diameter, the tappet has a diameter that is only slightly larger, and there is a space between the shim and the tappet for insertion of a shim removal tool.

Another object is to provide a tappet and shim assembly for operating between a camshaft and a valve in an internal combustion engine wherein the shim is a dual-diameter shim having a small diameter portion that is received in a recess in the top of the tappet and a larger diameter portion having a cam contact surface at its end of suitable minimum diameter, the tappet has a diameter that is only slightly larger, and there is a space that is established between the shim and the tappet at their assembly for insertion of a shim removal tool.

Another object is to provide a tappet and shim assembly for operating between a camshaft and a valve in an internal combustion engine wherein the shim is a dual-diameter shim having a small diameter portion that is received in a recess in the top of the tappet and a larger diameter portion having a cam contact surface at its end of suitable minimum diameter, the tappet has a diameter that is only slightly larger, there is a space that is established between the shim and the tappet at their assembly for insertion of a shim removal tool, and the large diameter shim portion has one or more notches in a back edge thereof for insertion of a tool to depress the tappet to replace an existing shim from underneath the cam lobe.

Another object is to provide a very compact tappet and shim assembly for operating between a camshaft and a valve in an internal combustion engine characterized by a dual-diameter shim that is received in the top of the tappet and permits a smaller than normal tappet diameter.

These and other objects, advantages and features of the present invention will become more apparent from the following description and accompanying drawings wherein:

DETAILED DESCRIPTION OF THE DRAWINGS

Figure 1:
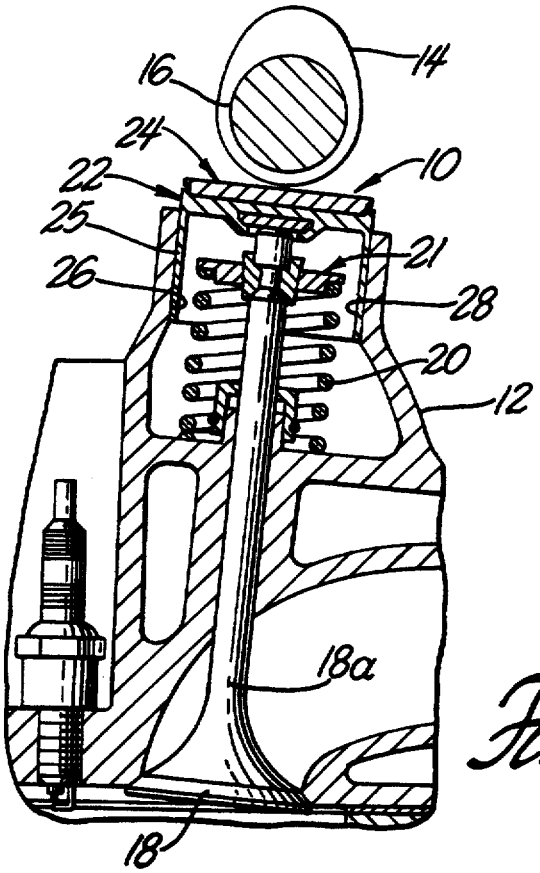
FIG. 1 is a cross-sectional view of a preferred embodiment of the tappet and shim assembly according to the present invention installed in the cylinder head of an internal combustion engine, only a portion of the cylinder head being shown.

Referring to FIG. 1, there is illustrated a tappet and shim assembly 10 installed in a cylinder head 12 of a dual overhead cam internal combustion engine between a lobe 14 of an overhead camshaft 16 and an intake valve 18 that is biased to close by a spring 20; the spring being compressed between the cylinder head and a valve spring seat assembly 21 of a conventional type that is retained on the upper end of the valve stem 18A. It will be understood that the engine has two such camshafts (one for the intake valves as shown and another for the exhaust valves), and that a similar tappet and shim assembly is installed between each of their cam lobes and the respective valves that they operate. It will also be understood that the engine may have any suitable number of cylinders and that there may be one or two intake valves and one or two exhaust valves for each cylinder and a corresponding number of cam lobes and tappet and shim assemblies therefor.

The tappet and shim assembly 10 provides for the cam lobe 14 to act directly therethrough on the valve 18 against its spring 20 to effect opening and closing of the valve in a conventional manner. The tappet and shim assembly 10 comprises a thin wall tappet 22 of bucket shape and a dual-diameter shim 24 that is installed in the top of the tappet and is made available in various size thicknesses as described later to set the desired valve clearance or lash between the base circle of the cam lobe and the shim. The tappet 22 has an outer cylindrical surface 25 that is closely received in a circular bore 26 in the head 12 and is slidably guided thereby for reciprocal movement to operate the valve. The tappet has a deep cylindrical cavity 28 in its lower end receiving an upper portion of the valve spring 20 and the valve stem 18A which is located central of the spring. The tappet 22 is made of aluminum for lightness and has a steel insert 32 centrally located in the bottom of the cavity 28 that contacts with the end of the valve stem to transmit forces between the relatively soft aluminum body of the tappet and the valve.

Figure 2:
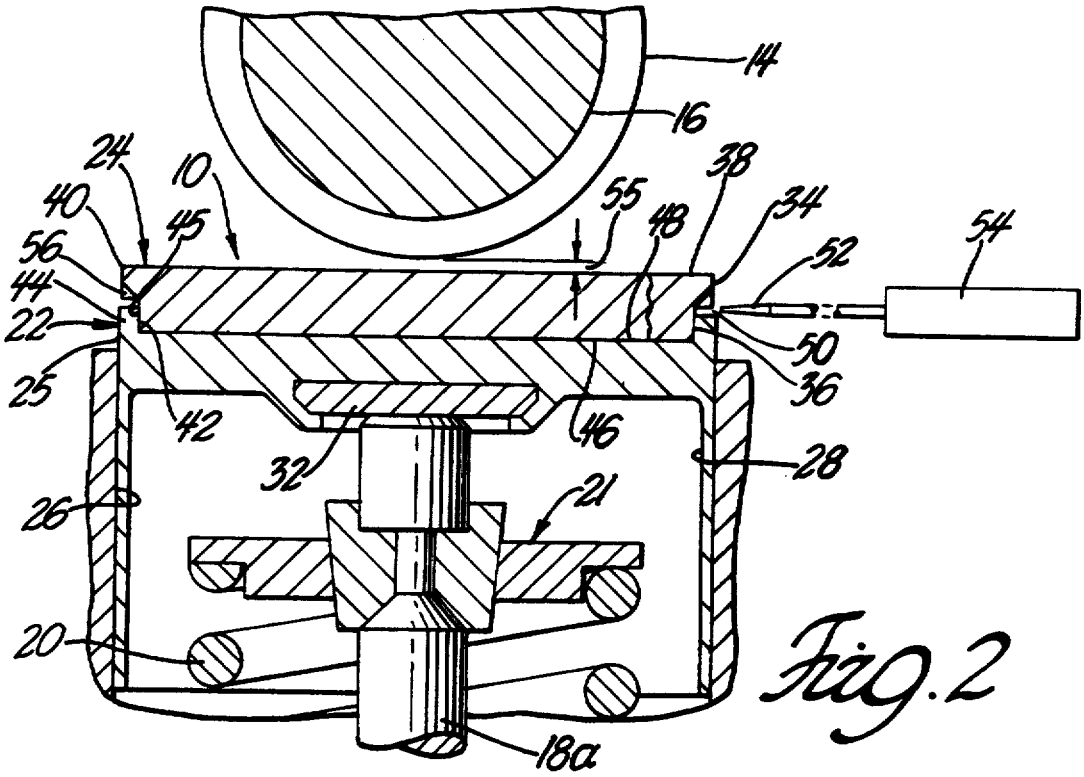
FIG. 2 is an enlargement of the tappet and shim assembly installation in FIG. 1 and includes a tool for separating the shim from the tappet.
Figure 3:
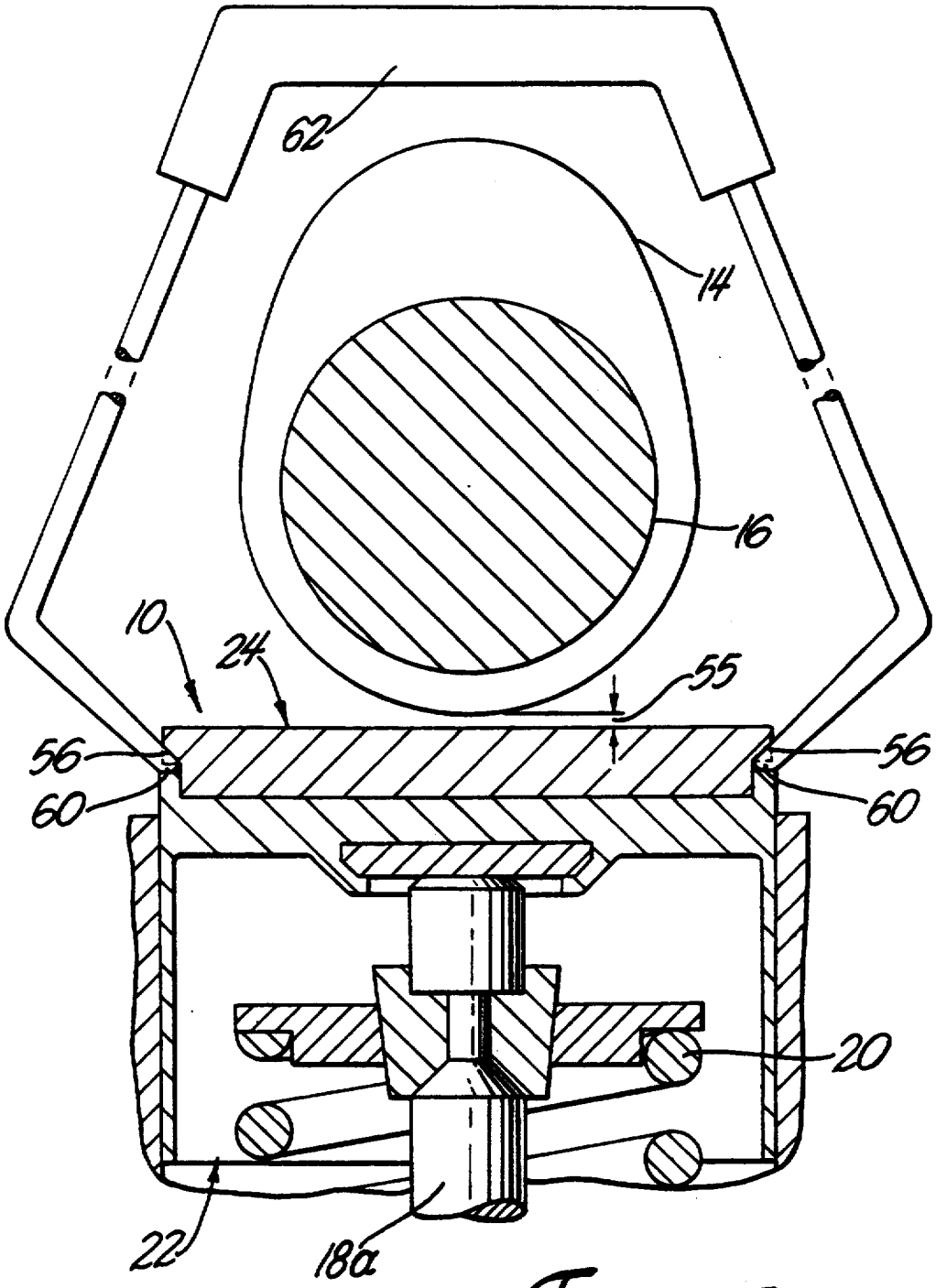
FIG. 3 is a view similar to FIG. 2 but includes a tool for depressing the tappet to permit removal of the shim with the tool in FIG. 2.

Referring to FIGS. 2 and 3, the dual-diameter shim 24 is formed with a relatively large diameter cylindrical portion 34 and a concentric small diameter cylindrical portion 36. The large diameter shim portion 34 has a flat circular end face 38 perpendicular to the centerline of the shim that contacts with the cam lobe 14 and is provided with a diameter that is sufficiently large enough so that contact is avoided between the cam lobe and the edge 40 of the shim face 38. This diameter will vary with the valve lift designed into the cam lobe and must increase therewith to maintain the avoidance of such edge contact with the shim. The small diameter shim portion 36 is received in a shallow cylindrical recess 42 in the top of the tappet that is concentric with the outer cylindrical surface of the tappet. The small diameter shim portion 36 is provided with a diameter that is only slightly smaller than that of the larger diameter shim portion 34 by an amount sufficient to allow a thin annular wall 44 of suitable strength to be formed in the tappet with the formation of the recess 42. The upper end of the thin wall 44 is defined by a narrow, flat, radial, annular surface 45 that extends at the top of the tappet between its outer cylindrical surface and the centrally located shim receiving recess.

The diameter of the outer cylindrical surface 25 of the tappet is determined from the minimum required diameter of the large diameter shim portion 34 and is made just slightly larger so that the latter is receivable with a small clearance such as 0.025 mm in the tappet bore. This clearance is significantly less than the diametrical expansion that would be required of the tappet to accommodate the large cylindrical shim portion 34 in a recess therein like the recess 42. In other words, it is the diameter of the large diameter shim portion rather than the thickness of the recess wall 44 that determines the smallest allowable diameter of the tappet and this allows the tappet to be made smaller than one with a single-diameter shim and only slightly larger than a tappet that is contacted directly by the cam lobe. For example, it was found that the tappet diameter in a certain valve train could be reduced from about 30.0 mm to 27.0 mm or 10% while still avoiding edge contact of the cam lobes with the shims by employing the tappet and shim assembly herein in place of a tappet with a single-diameter shim received in a recess in the top thereof.

The axial thickness of the small and large diameter shim sections are made about equal and the total thickness of the shim may be adjusted to accommodate shims whose thickness is determined by the material of which they are made. For example, in the case where the dual-diameter shim in made of hardened steel for a cast iron camshaft, the total thickness of the shim may need to be only about 2.0 mm. In the case where the dual-diameter shim is made of cast iron for a steel camshaft, the total thickness of the dual-diameter shim may need to be about 4.0 mm and the dual-diameter shim is well suited for this purpose as its large diameter portion is suited to heat treating such as in a conventional heat treating chilling process to harden its cam contacting end face while the small diameter portion is allowed to remain soft for strength.

The small diameter shim portion 36 has a flat circular end face 46 that is perpendicular to the shim centerline and is adapted to bottom in the recess in the tappet. The small diameter shim portion 36 is provided with an axial length or thickness that is larger than the depth of the recess 42 so that on bottoming out at its flat end face 46 on the flat bottom 48 of the recess, the large diameter shim portion is located at a predetermined small distance from the flat, annular surface 45 at the top of the tappet to form an annular clearance or space 50 therebetween. This extended axial thickness of the small diameter shim portion 36 is selected so that the width of the space 50 will allow the insertion of the sharp end 52 of a screw driver 54 as illustrated in FIG. 2 to effect removal of the shim from the tappet with a prying action. For such removal, the tappet must be depressed a sufficient distance against the valve spring to allow the shim to be removed from the recess in the top of the tappet clear of the cam lobe. The manner by which the tappet is depressed with the dual-diameter shim in place is described in detail later with reference to FIG. 3.

The valve clearance or lash is set by installing a dual-diameter shim that establishes the desired clearance or space between its cam contacting end face and the base circle of the cam lobe with the valve closed as illustrated in the drawings (the valve clearance being designated by the reference numeral 55 and associated arrows in FIGS. 2 and 3). For this purpose, the size of the small diameter shim portion is maintained constant or fixed for a certain valve train and the axial thickness of the large diameter shim portion is varied to provide a selection of dual-diameter shim sizes for use as needed. For example, the dual-diameter shims can be thus made available in a range of sizes to suit a particular valve train so as to enable the establishment of the desired valve clearance setting at initial engine assembly within the range of manufacturing tolerances and for later possible adjustment to compensate for valve and valve seat regrinds and valve train wear in an engine rebuild.

Servicing of the tappets to replace existing shims with new shims to adjust the valve clearance while the camshaft remains in place is facilitated by the formation of a pair of identical notches or recesses 56 in the rear or back edge of the large diameter shim portion 34. The notches 56 have a rectangular cross-section and angle inwardly at about 45°-60° toward the centerline of the shim from below the cam lobe engaging end face 38 of the shim to the small diameter shim portion 36. The notches are spaced 180° apart and expose diametrically opposite portions of the flat annular surface 45 that forms the top edge of the tappet. The angled notches 56 are adapted to receive correspondingly angled ends 60 of a hand tool 62 at opposite sides of the camshaft as illustrated in FIG. 3. The tappet is turned in its bore, if necessary, by grasping and turning the tappet at its outer cylindrical diameter where it projects outward of the tappet bore with the valve closed so as to position the notches at opposite sides of the cam lobe to receive the tool ends 60. The tool ends 60 have a cross-section corresponding to that of the notches and are inserted in the notches and thus past the cam engaging face 38 of the shim to engage the top edge of the tappet at these locations. The tool 62 is then pressed downward on the tappet to compress the valve spring while leaving the shim free in the recess in the tappet beneath the cam lobe. The tappet is forced downward in the tappet bore a sufficient distance so that the dual-diameter shim can then be removed clear of the cam lobe by inserting the shim removal tool 54 in the annular space 50 between the large diameter shim portion and the top edge of the tappet as described earlier. Then while continuing to hold the tappet down against the valve spring with the tool 62, a new dual-diameter shim of the desired thickness is inserted in the recess in the top of the tappet to adjust the valve clearance to the desired setting. With the new dual-diameter shim thus installed, the pressure on the tappet depressing tool is relaxed and the tool is removed to release the valve spring for it normal operation.

It will also be understood that there are other forms of tools that could be used with the shim notches 56 to depress and hold the tappet as well as separate the dual-diameter shim from the tappet using the annular space 50 therebetween. For example, the tappet depressing tool could be a lever type tool have pivotally joined ends that are receivable in the notches 52. Furthermore, it is possible to depress the tappet using a tool in only one of notches 56. On the other hand, the shim separation tool could simply be a knife blade, a thin strip of metal and the like that will fit in the annular space 50 between the dual-diameter shim and the tappet.

The invention has been described in an illustrative manner with respect to presently preferred embodiments, and it is to be understood that the terminology that has been used is intended to be in the nature of words of description rather than words of limitation. Obviously, many modifications and variations of the present invention in light of the above teachings may be made. It is therefore to be understood that within the scope of the appended claims, the invention may be practiced otherwise than as specifically shown and described.

What is claimed is:

1. A tappet and shim assembly for operating between a valve and a camshaft in an internal combustion engine, said assembly comprising a tappet having a cylindrical recess in one end thereof concentric with an outer cylindrical surface of said tappet, and a dual-diameter cylindrical shim having concentric small and large diameter cylindrical portions, said large diameter cylindrical portion having a circular end face adapted to contact with a cam lobe of a camshaft, said small diameter portion received in and bottoming out in said recess and having an axial dimension larger than the depth of said recess so as to space said large diameter cylindrical portion at a distance from said one end to form a space therebetween for insertion of a tool to remove said shim from said tappet.

2. A tappet and shim assembly for operating between a valve and a camshaft in an internal combustion engine, said assembly comprising a tappet having an outer cylindrical surface adapted to be received in a tappet bore, a cylindrical recess in one end of said tappet concentric with said outer cylindrical surface, and a dual-diameter cylindrical shim having concentric small and large diameter cylindrical portions, said small diameter cylindrical portion received in said recess, said large diameter portion extending from said one end of said tappet and having a diameter slightly smaller than that of said outer cylindrical surface of said tappet, said large diameter cylindrical portion having a circular flat end face adapted to contact with a cam lobe of a camshaft, said small diameter portion bottoms out in said recess and has an axial dimension so as to space said large diameter cylindrical portion at a distance from said one end of maid tappet to form an annular space therebetween for insertion of a tool to remove said shim from said tappet.

3. A tappet and shim assembly as set forth in claim 2 wherein said end face has a diameter that is the minimum required to prevent an edge of this face from contacting with the cam lobe.

4. A tappet and shim assembly as set forth in claim 2 wherein the axial dimension of said small diameter cylindrical portion is fixed and that of said large diameter cylindrical portion is adapted to vary to vary the thickness of said shim for the establishment of different valve clearance settings.

5. A tappet and shim assembly as set forth in claim 2 wherein said shim is made of iron and said end surface of said large cylindrical portioned is hardened while said small cylindrical portion remains relatively soft for strength.

6. A tappet and shim assembly as set forth in claim 2 wherein said shim has at least one notch in a rear edge of said large cylindrical portion extending to said small cylindrical portion and exposing a portion of a top edge of said tappet outward of said small cylindrical portion, said notch adapted to receive a tool to engage with said top edge of said tappet and depress said tappet in said tappet bore to allow removal of said shim and installation of another dual-diameter cylindrical shim.

7. A tappet and shim assembly as set forth in claim 6 wherein there are two of said notches located diametrically opposite each other.

8. A tappet and shim assembly as set forth in claim 6 wherein said notch has a rectangular cross-section to receive a tool of corresponding cross-section.

* * * * *